US005768807A

United States Patent [19]

Caeran et al.

[11] Patent Number: 5,768,807

[45] Date of Patent: Jun. 23, 1998

[54] SPORTS SHOE

[75] Inventors: Francesco Caeran, Montebelluna; Alessandro Pozzobon, Paderno di Ponzano Veneto, both of Italy

[73] Assignee: Nordica S.p.A., Trevignano, Italy

[21] Appl. No.: 713,315

[22] Filed: Sep. 13, 1996

[30] Foreign Application Priority Data

Sep. 22, 1995 [IT] Italy ..... TV95A0110

[51] Int. Cl.[6] ..... A43B 5/04; A43B 5/16

[52] U.S. Cl. ..... 36/115; 36/117.1

[58] Field of Search ..... 36/115, 50.1, 50.5, 36/45, 55, 117.1

[56] References Cited

U.S. PATENT DOCUMENTS

| | | | |
|---|---|---|---|
| 1,986,580 | 1/1935 | Johnson | 36/115 |
| 4,342,161 | 8/1982 | Schmohl | 36/50.1 |
| 4,835,885 | 6/1989 | Hoshizaki et al. | 36/115 |
| 5,171,033 | 12/1992 | Olson et al. | 36/115 |
| 5,357,695 | 10/1994 | Lu . | |
| 5,397,141 | 3/1995 | Hoshizaki . | |

FOREIGN PATENT DOCUMENTS

| | | |
|---|---|---|
| 0 465 222 | 1/1992 | European Pat. Off. . |
| 0 551 704 | 7/1993 | European Pat. Off. . |
| 2 668 072 | 4/1992 | France . |
| 2 856 893 | 1/1980 | Germany . |

*Primary Examiner*—Paul T. Sewell
*Assistant Examiner*—Anthony Stashick
*Attorney, Agent, or Firm*—Guido Modiano; Albert Josif

[57] ABSTRACT

A sports shoe, particularly for skates, includes a rigid shell, and a soft innerboot; separate straps for connecting the innerboot to the rigid shell are laterally rigidly coupled to the innerboot and at least partially surround the shell. First and second flaps of the innerboot are fastened to the straps which advantageously do not affect the metatarsal and/or foot instep regions.

20 Claims, 5 Drawing Sheets

SPORTS SHOE

BACKGROUND OF THE INVENTION

The present invention relates to a sports shoe, particularly for skates, and other sports such as mountaineering, trekking, climbing, soccer and football and leisure in general.

Nowadays it is known to use, for in-line skates, shoes that are associated with an underlying frame for supporting a plurality of wheels.

Canadian patent No. 2071806 discloses a skate with in-line wheels that has a removable soft innerboot.

The skate is constituted by a wheel supporting frame that also comprises a shell that partially surrounds the innerboot at its edge by means of a retention bar that protrudes upwards from the outer side of the toe of the foot and affects only a part thereof that lies above the first toes due to its inclined arrangement with respect to the longitudinal axis of the foot.

Therefore, this configuration of the shell entails only lateral containment regions on the toe unit, on the heel, and only to a very small extent on the sides of the foot, thus limiting the containment of the median-lateral region, so as to allow the innerboot to slip out while the foot is still inserted even during sports practice.

Therefore, the structure of the shell thus shaped does not ensure locking of the innerboot to said shell, due to the small number of locking points that allow the innerboot to still perform relative movements inside the shell, with a tendency to move both longitudinally with respect to the skate, even if the lever located on the cuff is fastened tightly, and transversely to the skate.

These movements can therefore cause the innerboot to dangerously slip out of the shell during skating, with severe consequences for the user.

These drawbacks also entail less control and maneuverability of the sports implement; since skating technique is characterized by lateral thrusts of the foot to achieve the desired movement, the limited lateral support applied by the shell to the innerboot is particularly disadvantageous.

This drawback is also noted in performing the so-called "side-slip" braking technique, which entails optimum lateral retention of the shell.

As a partial solution to these drawbacks, Canadian pat. No. 2101718 discloses an in-line skate having a shell that partially surrounds a soft innerboot and is associated with the frame of the skate. The shell has a front toe unit, which partially surrounds the tip of the shoe, and perimetric guiding seats for a first strap that surrounds the upper part of the foot, compressing it, and for a second strap that surrounds the foot instep.

Although these straps allow to retain the innerboot in the shell, preventing it from slipping out, they nonetheless do not fully eliminate the problem of the relative movements between the two components. Furthermore, the effect of the straps is to compress the foot against the bottom of the shell, without being able to make the innerboot adhere laterally to the shell in an optimum manner.

During sports practice, the stresses that act on the shell are countless and have different characteristics; therefore, the user is forced to apply a high degree of tightening to the strap: excessively tight closing, however, causes unpleasant discomfort to the user's foot, such as pain areas where the strap applies its pressure or difficult blood circulation due to excessive pressure on the foot.

The only remedy is not to tighten the straps too much, but in this case the innerboot will not be secured in the shell.

WO-95/03101 discloses a structure of a shoe for a skate with in-line wheels that comprises a shell that only partially surrounds a soft innerboot, which is fixed to the shell by gluing it.

A quarter is articulated to the shell and has flaps that surround the tibial region and fasten the innerboot by means of an adapted lever; the shell is laterally provided with two seats for guiding a strap that affects the foot instep region.

However, this solution, too, has drawbacks, such as the industrialization of the step for gluing the innerboot, which is very difficult, because of the shape of the shells to which the innerboot must be glued.

Furthermore, gluing entails imperfect finishes, because of the possible presence of smears and smudges of glue on the innerboot along the perimeter of the shell, thus worsening its aesthetic appearance. Furthermore, in the case of production rejects, both the innerboot and the shell cannot be recovered.

Finally, during sports practice the foot tends to move inside the innerboot due to the forces that are applied; the continuous actions of compression and traction forces entail the gradual separation of the innerboot from the shell, thus allowing the innerboot to perform unwanted movements, with a gradual decrease in skate control.

SUMMARY OF THE INVENTION

The aim of the present invention is therefore to solve the technical problems that have been pointed out, eliminating the drawbacks of the mentioned prior art by providing an innerboot that is detachably associable with a rigid shell and, once associated therewith, is free from possible relative movements inside said shell, allowing optimum transmission of forces to a supporting frame for wheels or to a sole.

Within the scope of the above aim, an important object is to provide a shoe that allows optimum control and maneuverability of the skate and good lateral retention of the shell both during skating and during braking according to the so-called "side-slip" technique.

Another object is to provide a shoe that despite achieving the above characteristics allows to avoid applying localized forces at the metatarsal and/or foot instep regions and/or compression of the foot against the lower surface of the shell.

Another important object is to provide a shoe that allows more effective industrialization and allows to recover any errors during assembly.

Another object is to provide an innerboot in which the use of glues can be eliminated.

Another object is to provide a shoe that is adapted to be aesthetically customized and is reliable and safe in use.

This aim, these objects, and others which will become apparent hereinafter are achieved by a sports shoe comprising a rigid shell and a soft innerboot, characterized in that separate connecting means for connecting said innerboot to said rigid shell are laterally rigidly associated with said innerboot.

Conveniently, said connecting means at least partially surround said shell.

Advantageously, fastening means for the first and second flaps of said innerboot are associated with said connecting means, which do not affect the metatarsal and/or instep regions of the foot.

BRIEF DESCRIPTION OF THE DRAWINGS

Further characteristics and advantages of the invention will become apparent from the detailed description of some particular embodiments, illustrated only by way of non-limitative example in the accompanying drawings, wherein.

DESCRIPTION OF THE PREFERRED EMBODIMENTS

Figure 1:
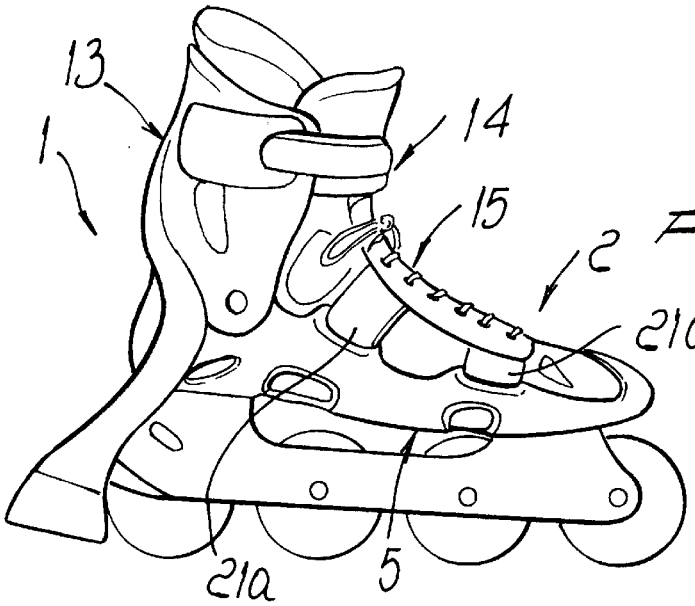
FIG. 1 is a side view of a skate according to the invention.
Figure 3:
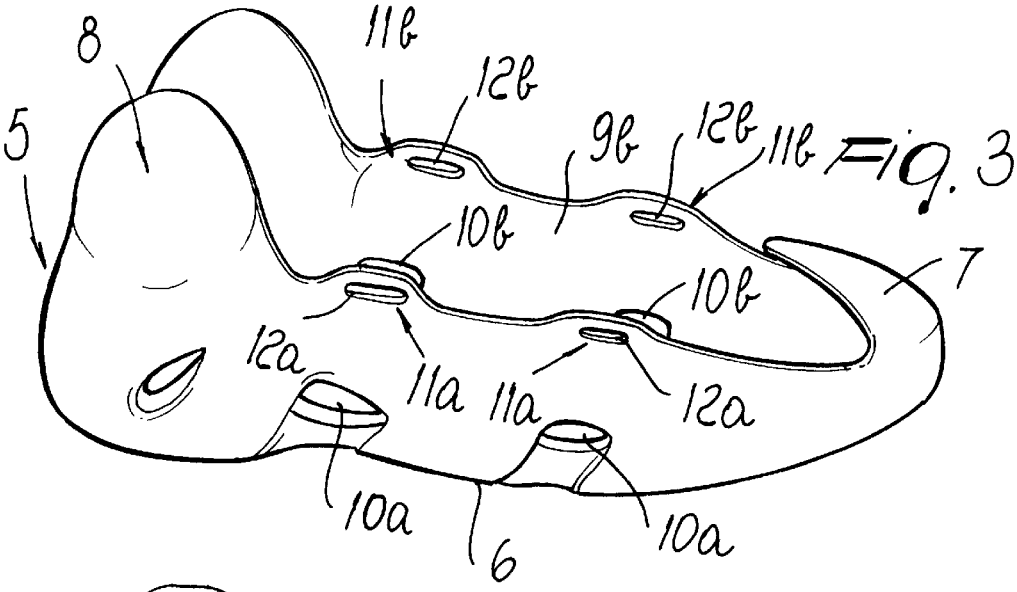
FIG. 3 is aeperspective view of a first embodiment of the shell.
Figure 4:
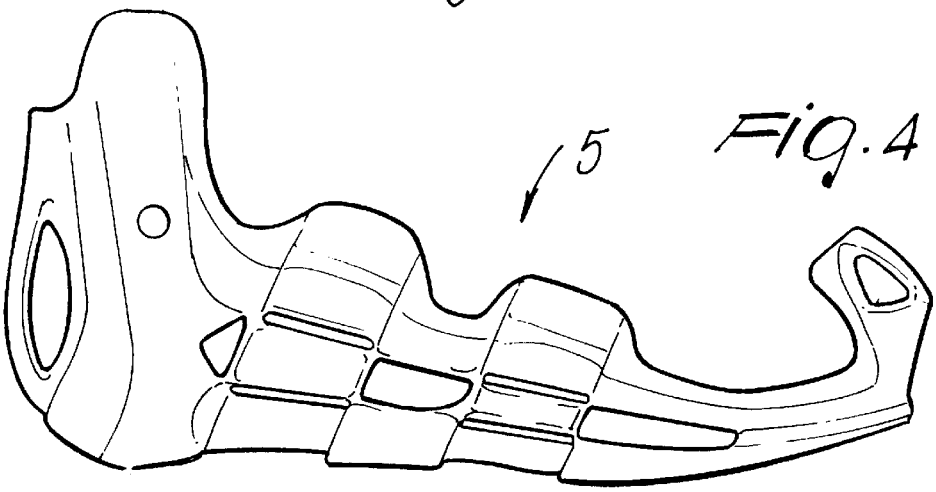
FIG. 4 is a perspective v of a second embodiment of the shell.
Figure 2:
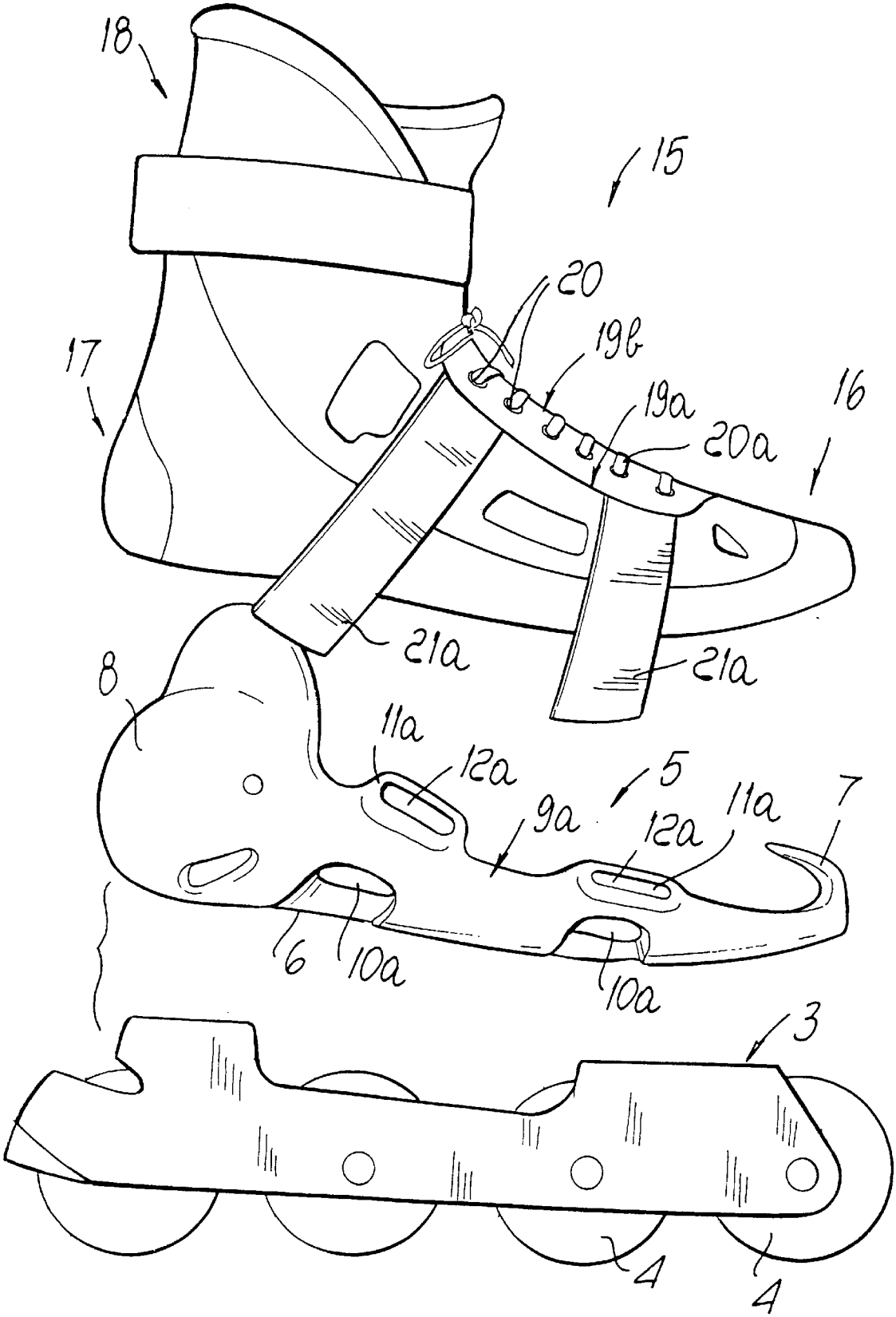
FIG. 2 is an exploded perspective view of the skate of FIG. 1.

With reference to the above figures, the reference numeral 1 designates a skate that comprises a shoe 2 below which a frame 3 is associated. A plurality of wheels 4 are pivoted to frame 3, so that each of their axis lies transversely to frame 3. In this particular embodiment, there are four in-line wheels.

Shoe 2 is constituted by a shell 5 that has a base 6 that can be associated with frame 3 or with the rigid or non-rigid sole of shoe for soccer, cycling, ice-skating, mountaineering, trekking, climbing, or leisure.

A toe unit 7 protrudes at the front from base 6 and is curved toward the rear part of shell 5, where a cup 8 protrudes which is adapted to surround the heel of the user.

Shell 5 also has two side walls 9*a* and 9*b* that are interposed between toe unit 7 and cup 8.

One or more pairs of first slits 10*a* and 10*b* are formed in the pair of walls 9*a* and 9*b*, and are arranged below the upper edge. Slits 10*a*, 10*b* are formed along an axis that is approximately longitudinal to shell 5. Preferably, the slits are formed proximate to cup 8 and/or to toe unit 7. The pairs of first slits 10*a* and 10*b* are arranged approximately symmetrically to each other with respect to a median plane that lies longitudinally to base 6. one or more pairs of tabs 11*a* and 11*b* protrude from the upper edge of walls 9*a* and 9*b*, and one or more pairs of second slits 12*a* and 12*b* are formed at the first pairs of tabs.

It is optionally possible to associate a quarter 13 with shell 5. Quarter 13 can be articulated at the cup 8 and is open at the front, and can be fastened by means of a conventional first lever-like closure element 14.

Shoe 2 also comprises a soft innerboot 15 that can be inserted in shell 5 so that a first region 16 of the tip lies at toe unit 7 and a second region 17 of the heel lies at cup 8.

Innerboot 15 has a cuff 18 that partially surrounds the user's leg and is optionally partially surrounded by quarter 13.

Innerboot 15 has a front opening that forms a first flap 19*a* and a second flap 19*b* on which a plurality of holes 20 are formed that allow the passage of a lace 20*a* in order to be able to mutually fasten first flap 19*a* and second flap 19*b*, so as to secure the user's foot inside innerboot 15.

of course, it is possible to use other conventional fastening device, such as levers or tear-open bands, without thereby abandoning the inventive concept.

Connecting means, such as for example a first pair of straps 21*a* and optionally a second pair of straps 21*b*, protrude laterally from the first and second flaps 19*a* and 19*b* and are rigidly coupled to them.

The two first straps 21*a*, which are arranged approximately symmetrically with respect to each other, are associated by means of one end respectively with the first flap 19*a* and with the second flap 19*b* and are arranged proximate to the first region 16 of the tip. The two second straps 21*b* are instead arranged proximate to the foot instep.

The positioning of one or more pairs of straps of course depends on the particular configuration of the shell and on the specific contingent requirements.

The first and second pairs of straps 21*a* and 21*b* laterally surround shell 5, are inserted at the pair of second slits 12*a* and 12*b*, then exit from shell 5 at the pair of first slits 10*a* and 10*b* so as to externally affect the shell in a downward region, and are secured below base 6.

Figure 5:
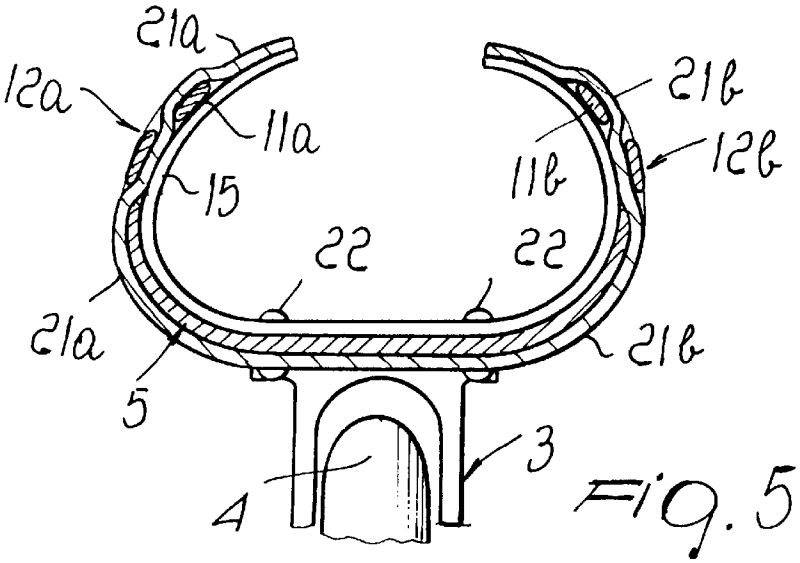
FIGS. 5, 6, 7, and &/are cross-section views of four embodiments of the invention, taken along a plane that lies transversely teo the innerboot.
Figure 7:
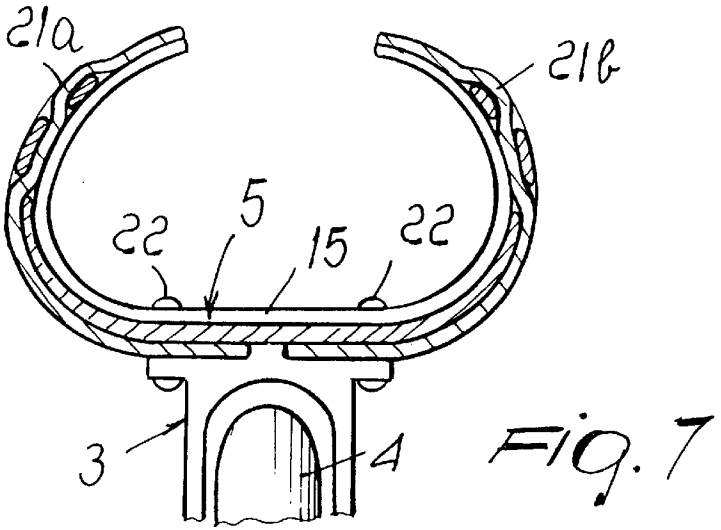

First and second pairs of straps 21*a* and 21*b* can be secured in different ways: for example, FIG. 5 shows a solution in which straps 21*a* and 21*b* are secured to the base 6 by means of rivets 22. As shown in FIG. 7, the securing action can simultaneously affect frame 3.

Figure 6:
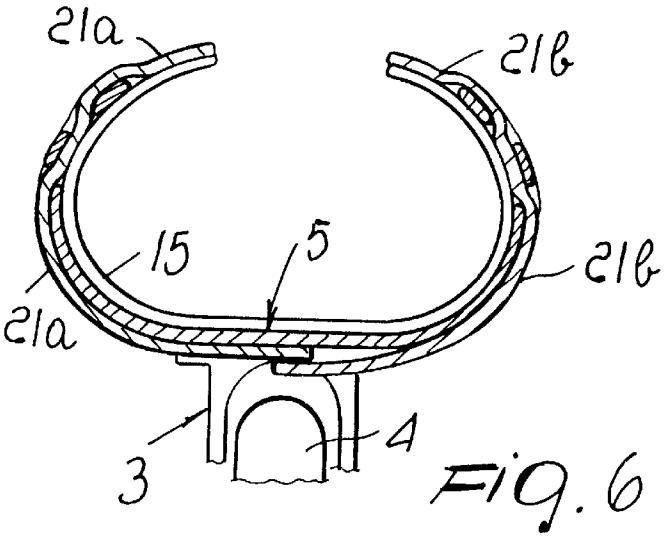

As an alternative, straps 21*a* and 21*b* can be mutually connected below the base 6 by gluing, welding, or other conventional systems, as shown in FIG. 6.

First slits 10*a* and 10*b* and second slits 12*a* said 12*b* allow the first straps 21*a* and the optional second straps 21*b* to surround shell 5 in a guided manner, preventing the longitudinal movement of the straps with respect to shell 5.

The operation is as follows: the user, by applying tension to lace 20 or similar fastening devices, and by fastening it, makes innerboot 15 optimally adhere to the foot. Accordingly, the first straps 21*a* and the optional second straps 21*b*, which are rigidly connected to first and second flaps 19*a* and 19*b* and simultaneously to shell 5, are partially tensioned, making the shell adhere to innerboot 15 so as to achieve maximum rigidity and structural compactness.

It has thus been observed that the invention has achieved the intended aim and objects, a shoe having been provided in which a soft innerboot is detachably associated with a rigid shell so that it is free from possible relative movements inside said shell, allowing optimum transmission of forces during skating. The shoe thus obtained is therefore extremely compact and has high structural rigidity.

Furthermore, this solution allows optimum control and maneuverability of the skate both during skating and during braking, according to the so-called "side-slip" technique, by virtue of the optimum adhesion of the innerboot to the inside walls of the shell, which ensures high lateral retention.

Moreover, the invention allows to avoid applying forces that are localized at the metatarsal and/or foot instep regions and/or compression of the foot against the lower surface of the shell, since adhesion to the walls of the shell is achieved by means of a traction that is applied to the innerboot by means of the straps instead of by means of a compression that acts on the foot.

Finally, a shoe has been obtained that allows more effective industrialization and allows to recover any errors during assembly, since the connection between the shell and the innerboot is not of the permanent kind.

The shoe according to the invention is susceptible of numerous modifications and variations, all of which are within the scope of the same inventive concept.

Figure 9:
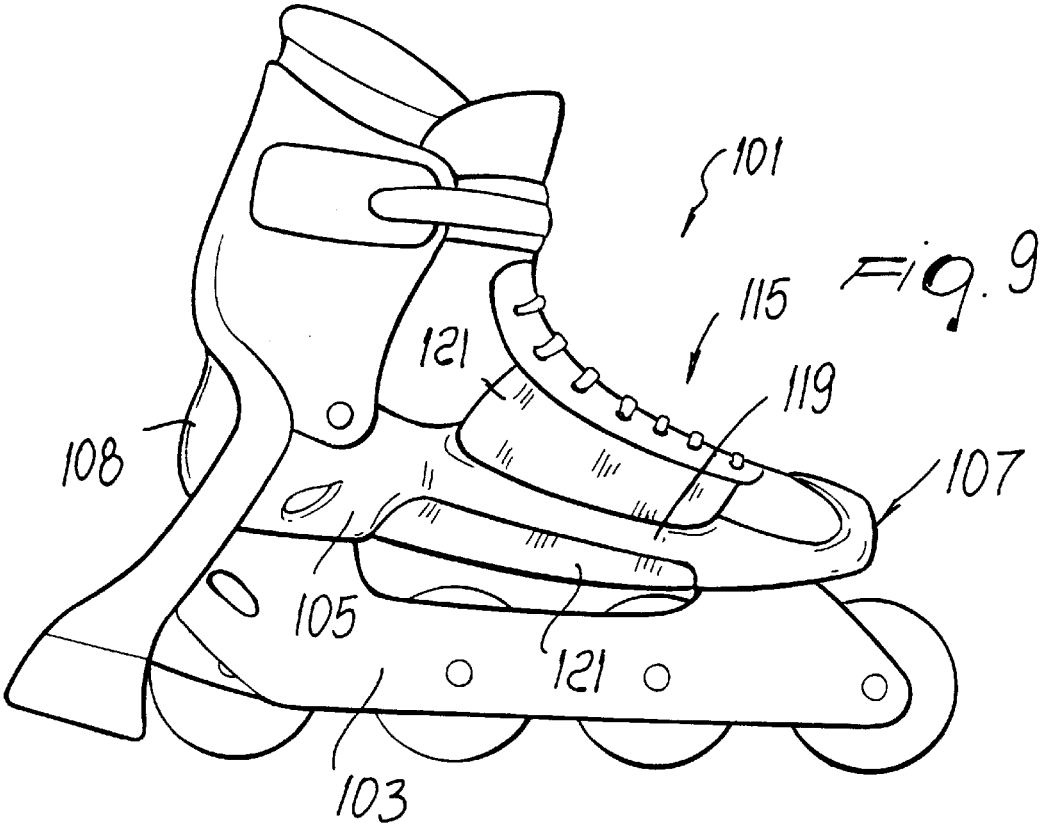
FIG. 9 is a'side view of a further embodiment.

Thus, for example, FIG. 9 illustrates a further embodiment, in which the skate 101 is constituted by a frame 103 above which a shell 105 is associated. An innerboot 115 of the soft type can be accommodated inside the shell.

Shell 105 is provided with a toe unit 107 that protrudes upwards and is curved toward the rear part, at which there is instead a cup 108 that protrudes on the same side as the toe unit 107 and surrounds the heel of the user.

Shell 105 also has two side walls that are interposed between toe unit 107 and cup 108.

A first slit and a second slit are formed at each side wall, longitudinally to shell 105, starting from the region of the shell that lies proximate to cup 108 up to the region that lies proximate to toe unit 107.

One end of a single pair of straps 121, which constitutes said connecting means, is associated with the first and second flaps 119 of innerboot 115. Straps 121 have a longitudinal length that approximately corresponds to the length of first and second slits formed at the side wall of shell 105.

This solution, too, allows to achieve the intended aim and objects.

Figure 8:
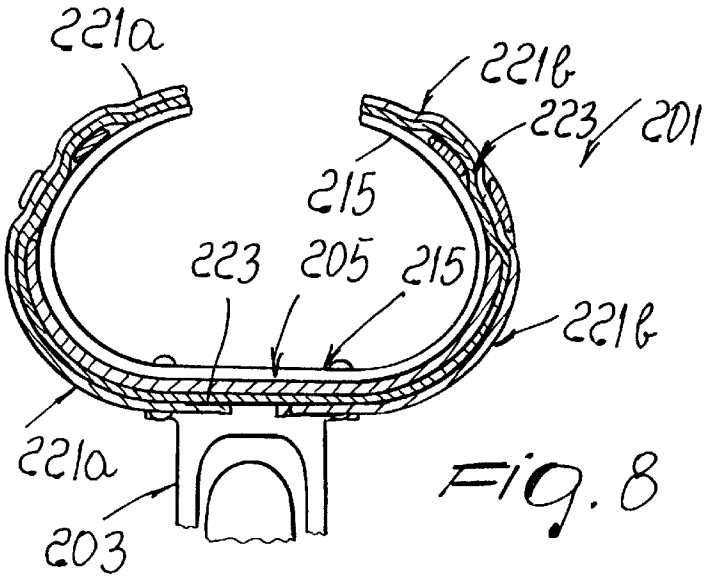

FIG. 8 illustrates a further embodiment, in which the skate 201 is constituted by a frame 203 that supports a shell 205 that is laterally provided with at least a first pair of slits and a second pair of slits that are parallel to each other.

At least two straps 221*a* and 221*b* are associated with the first and second flaps of the innerboot 215; each strap surrounds shell 205 laterally and in a downward region.

A rigid support 223 is interposed between the internal lateral surface of each strap 221*a* and 221*b* and the outer lateral surface of the shell. The support is shaped complementarily to straps 221*a* and 221*b* so as to stiffen them and allow to use systems such as levers, laces, or tear-open bands to mutually close the first and second flaps.

Figure 10:
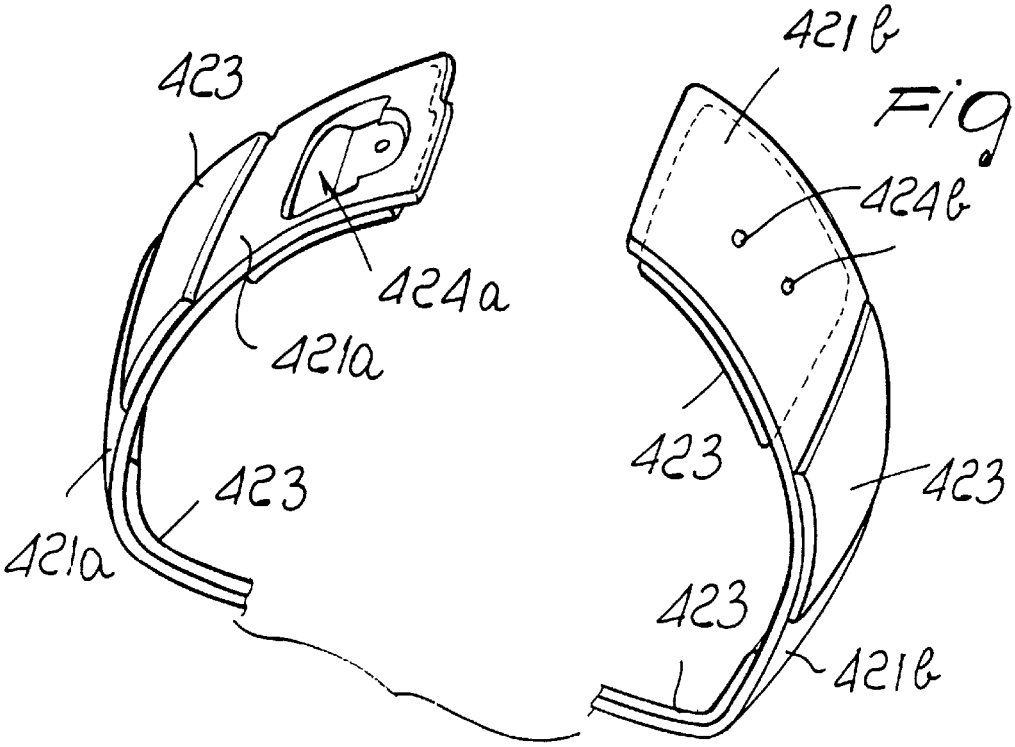
FIG. 10 is a front perspective view of an embodiment of a strap.

FIG. 10 shows a further embodiment, in which two straps 421*a* have, at the upper ends that are associable with the first and second flaps of an innerboot, adapted seats 424*a* and 424*b* for the connection of fastening means such as for example levers.

Straps 421*a* also have a plurality of rigid supports 423 that are associated above or below said straps and are adapted to improve their rigidity. Supports 423 can be obtained monolithically from the shell by means of the extension of the lateral tabs, which were designated by the reference numerals 11*a* and 11*b* in a previous embodiment.

This solution, too, allows to achieve the intended aim and objects.

Figure 11:
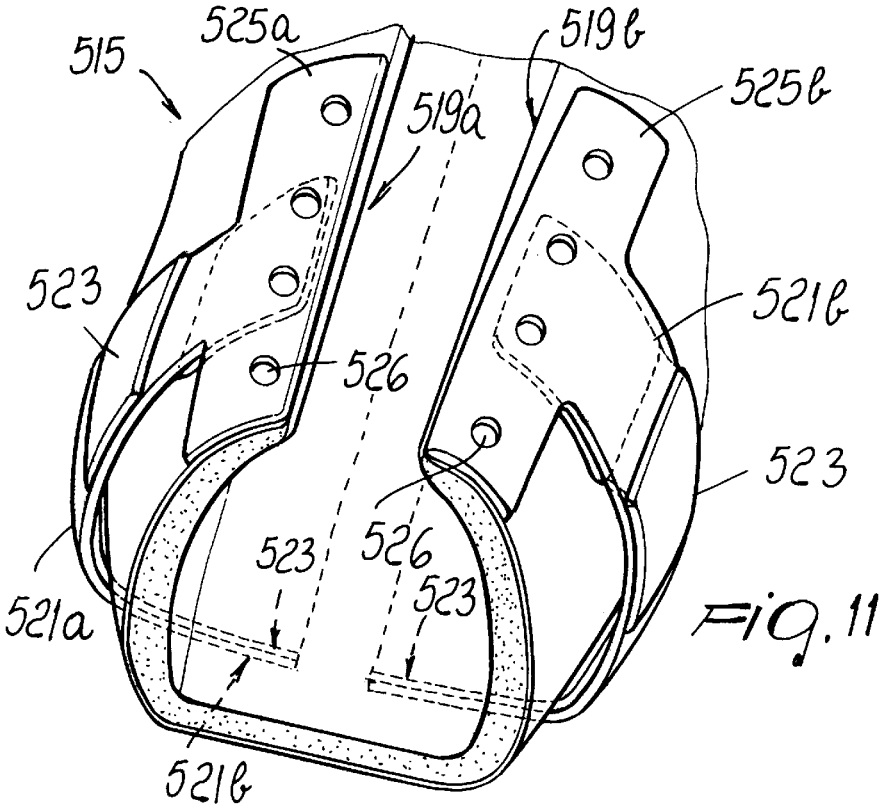
FIG. 11 is a front perspective view of a further embodiment of the strap.

FIG. 11 illustrates a further embodiment, in which the reference numeral 515 designates a soft innerboot inserted in a shell.

Innerboot 515 has at least two straps 521*a* and 521*b* that surround the shell in a downward region. The ends of the straps are associated, by stitching or other means, with a first flap 519*a* and a second flap 519*b* of innerboot 515.

A first belt 525*a* and a second belt 525*b* are associated with straps 521*a* and 521*b* and have a plurality of lace-holes 526 that are all arranged along a same directrix, which is parallel to first flap 519*a* and to second flap 519*b* respectively.

A support 523 is also associated with straps 521*a* and 521*b* and is adapted to improve their rigidity.

Figure 12:
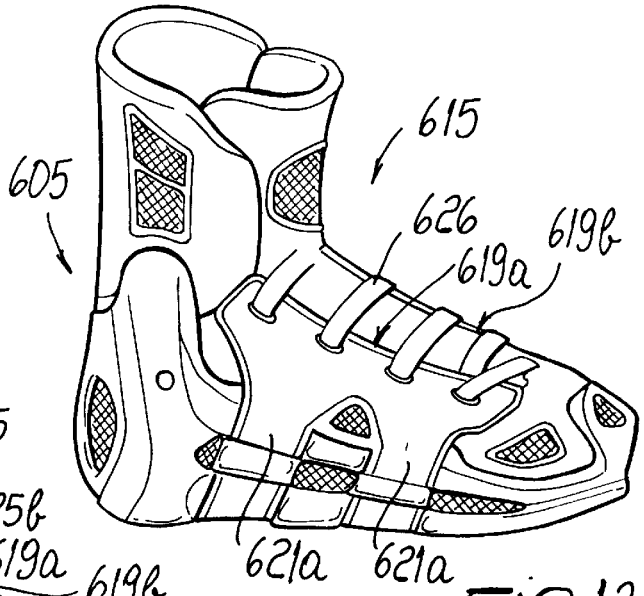
FIG. 12 is a teral perspective view of the innerboot associated with he shell of FIG. 4.
Figure 13:
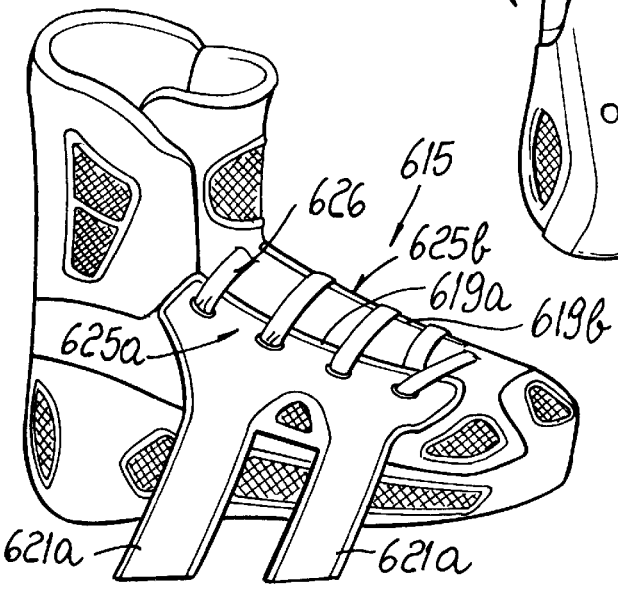
FIG. 13 is a lateral perspective view of the innerboot of FIG. 12.

FIGS. 12 and 13 illustrate a further embodiment, in which the reference numeral 615 designates an innerboot of the soft type, which has a first flap 619*a* and a second flap 619*b* to be joined.

A first pair of straps 621*a* and a second pair of straps 621*b* are associated with first flap 619*a* and with second flap 619*a* and 619*b* and are monolithic with a first belt 625*a* and a second belt 625*b* that are associated with the first flap and the second flap and are perforated to contain fastening means, such as for example a lace 626.

Innerboot 615 can be inserted in a shell 605 that is laterally provided with a first pair of slits and with a second pair of slits that are adapted to allow the passage of the first and second pairs of straps 621*a* and 621*b*, which thus surround shell 605 in a downward region.

This solution, too, allows to achieve the intended aim and objects.

The materials and the dimensions that constitute the individual components of the device may of course also be the most appropriate according to the specific requirements.

What is claimed is:

1. A sports shoe comprising a rigid shell and a soft innerboot arranged inside said rigid shell, wherein separate connecting means for connecting said innerboot to said rigid shell are rigidly connected with said innerboot, and wherein said innerboot is provided with a front opening that forms a first flap and a second flap which have fastening means to mutually fasten said first and second flaps, said connecting means comprising at least one pair of straps being rigidly coupled to said first and second flaps, said at least one pair of straps extending from said first and second flaps and being arranged about said rigid shell for connecting said innerboot with said rigid shell.

2. Shoe according to claim 1, wherein said shell comprises:

a base having a front and a rear;

a toe unit arranged at said front of said base for surrounding a user's toes;

a heel cup arranged at said rear of said base and adapted to surround a user's heel; and two side walls that are interposed between said toe unit and said heel cup.

3. Shoe according to claim 2, wherein first slits are formed in said pair of side walls and are approximately symmetrical with respect to a median longitudinal plane of said shell, said slits being formed proximate to said toe unit, and wherein second slits are formed above said first slits adjacent an upper edge of said walls, and wherein said straps are connected by means of one end respectively with said first and second flaps, laterally surround said shell, and are inserted at said second slits to then exit from said shell at said first slits so as to surround said shell at said base and be locked below said base.

4. Shoe according to claim 2, wherein at least one first slit and at least one second slit are formed in each of said pair of walls, are approximately parallel to each other along an axis that is approximately longitudinal to said shell, and are shorter than the length between said toe unit and said heel cup.

5. Shoe according to claim 3, wherein tabs protrude from an upper edge of said walls, second slits being formed above said first slits at said tabs.

6. Shoe according to claim 5, wherein said straps are secured by rivets.

7. Shoe according to claim 5, wherein said straps are simultaneously secured to said said frame.

8. Shoe according to claim 7, wherein said connecting means comprises a first pair of straps and a second pair of straps that are arranged respectively at a tip region and proximate to a foot instep region of said shoe.

9. Shoe according to claim 5, wherein a rigid support is interposed between an inner lateral surface of each strap and an outer lateral surface of said shell, said support being shaped complementarily to said strap so as to achieve stiffening to allow the use of systems for mutually closing said first and second flaps.

10. Shoe according to claim 5, wherein said straps have upper ends connected with said first and second flaps, and seats at said upper ends for accommodating fastening means, said straps having connected thereto a plurality of rigid supports formed monolithically from said shell by means of an extension of said tabs.

11. Shoe according to claim 1, wherein a first belt and a second belt are connected with said straps and have a plurality of lace-holes arranged along lines parallel to said first and second flaps respectively.

12. Shoe according to claim 1, wherein a first belt and a second belt are connected with said first and second flaps, are formed monolithically with said first and second pairs of straps, and are perforated for slidably accommodating laces.

13. A sports shoe comprising:

a rigid shell;

a soft innerboot arranged inside said rigid shell; said innerboot having an upper front longitudinal opening defining a pair of flaps;

a fastener device for mutually releasably closing said pair of flaps of said innerboot;

at least one pair of straps rigidly connected to said flaps and extending from said flaps about said rigid shell for connecting said innerboot inside said shell.

14. The sports shoe of claim 13 wherein first ends of said straps are rigidly connected adjacent edges of said flaps.

15. The sports shoe of claim 14 wherein said straps extend from said first ends for being arranged about said rigid shell, and wherein second ends of said straps are rigidly connected to said shell at a lower base region of said shell.

16. The sports shoe of claim 15 wherein said straps extend through slots provided in said shell.

17. A sports shoe comprising:

a rigid shell;

a soft innerboot arranged inside said rigid shell; said innerboot having an upper front longitudinal opening defining a pair of flaps;

fastening means for mutually releasably closing said pair of flaps of said innerboot;

at least one pair of connecting strap means rigidly connected to said flaps and extending from said flaps about said rigid shell for connecting said innerboot inside said shell.

18. The sports shoe of claim 17 wherein first ends of said connecting strap means are rigidly connected adjacent edges of said flaps.

19. The sports shoe of claim 18 wherein said connecting strap means extend from said first ends for being arranged about said rigid shell, and wherein second ends of said connecting strap means are rigidly connected to said shell at a lower base region of said shell.

20. The sports shoe of claim 19 wherein said connecting strap means extend through slot means provided in said shell.

* * * * *